US011158277B2

(12) United States Patent
Mitsuzawa et al.

(10) Patent No.: US 11,158,277 B2
(45) Date of Patent: Oct. 26, 2021

(54) DISPLAY DEVICE

(71) Applicant: Japan Display Inc., Tokyo (JP)

(72) Inventors: Yutaka Mitsuzawa, Tokyo (JP); Takayuki Nakao, Tokyo (JP); Masaya Tamaki, Tokyo (JP); Yutaka Ozawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/872,771

(22) Filed: May 12, 2020

(65) Prior Publication Data

US 2020/0273420 A1 Aug. 27, 2020

Related U.S. Application Data

(63) Continuation of application No. 15/949,556, filed on Apr. 10, 2018, now Pat. No. 10,692,455.

(30) Foreign Application Priority Data

Apr. 19, 2017 (JP) ..... JP2017-082851

(51) Int. Cl.
*G09G 3/36* (2006.01)
*G09G 3/32* (2016.01)

(52) U.S. Cl.
CPC ..... *G09G 3/3677* (2013.01); *G09G 3/3614* (2013.01); *G09G 3/3688* (2013.01);
(Continued)

(58) Field of Classification Search
CPC .. G09G 3/3677; G09G 3/3614; G09G 3/3688; G09G 2310/0297; G09G 3/32; G09G 2320/046; G09G 2300/0842
See application file for complete search history.

(56) References Cited

U.S. PATENT DOCUMENTS

2009/0091579 A1 4/2009 Teranishi et al.
2012/0099038 A1* 4/2012 Yoshiga ..... G09G 3/3648 349/33

FOREIGN PATENT DOCUMENTS

JP 2007-147932 A 6/2007

OTHER PUBLICATIONS

Japanese Office Action dated Jan. 5, 2021 for the corresponding Japanese Patent Application No. 2017-082851, with English machine translation.

* cited by examiner

*Primary Examiner* — Grace Q Li
(74) *Attorney, Agent, or Firm* — Michael Best & Friedrich LLP

(57) ABSTRACT

A display device includes: a plurality of sub-pixels each including a memory block that includes a plurality of memories each of which is configured to store sub-pixel data; a plurality of memory selection line groups provided to respective rows and each including a plurality of memory selection lines electrically coupled to the corresponding memory blocks in the sub-pixels that belong to a corresponding row; a memory selection circuit configured to simultaneously output a memory selection signal to the memory selection line groups, the memory selection signal being a signal for selecting one from the plurality of memories in each of the memory blocks. In accordance with the memory selection lines supplied with the memory selection signal, the sub-pixels display an image based on the sub-pixel data stored in memories in the respective sub-pixels, the memories each being one of the plurality of memories in the corresponding sub-pixel.

7 Claims, 9 Drawing Sheets

(52) U.S. Cl.
CPC ..... *G09G 3/32* (2013.01); *G09G 2300/0842* (2013.01); *G09G 2310/0297* (2013.01); *G09G 2320/046* (2013.01)

DISPLAY DEVICE

CROSS-REFERENCE TO RELATED APPLICATIONS

The present application is a Continuation of application Ser. No. 15/949,556, filed Apr. 10, 2018, which claims priority from Japanese Patent Application No. 2017-082851, filed on Apr. 19, 2017, the contents of which are incorporated by reference herein in its entirety.

BACKGROUND

1. Technical Field

The present invention relates to a display device.

2. Description of the Related Art

A display device, which displays images, includes a plurality of pixels. Japanese Patent Application Laid-open Publication No. 09-212140 (JP-A-09-212140) discloses what is called a memory-in-pixel (MIP) type display device in which each of the pixels includes memories. In the display device disclosed in JP-A-09-212140, each of the pixels includes a plurality of memories and a circuit that switches the memories from one to another.

In the display device disclosed in JP-A-09-212140, switching of the memories in each pixel is performed through line sequential scanning in which a switching circuit is controlled by a scanning signal. Therefore, the display device disclosed in JP-A-09-212140 needs a one-frame period to complete the switching from memories to other memories for all of the pixels. That is, the display device disclosed in JP-A-09-212140 needs a one-frame period to change an image (frame).

SUMMARY

According to an aspect, a display device includes: a plurality of sub-pixels arranged in a row direction and a column direction and each including a memory block that includes a plurality of memories each of which is configured to store therein sub-pixel data; a plurality of memory selection line groups provided to respective rows and each including a plurality of memory selection lines electrically coupled to the corresponding memory blocks in the sub-pixels that belong to the corresponding row; a memory selection circuit configured to simultaneously output a memory selection signal to the memory selection line groups, the memory selection signal being a signal for selecting one from the plurality of memories in each of the memory blocks. In accordance with the memory selection lines that have the memory selection signal supplied thereto, the sub-pixels display an image based on the sub-pixel data stored in memories in the respective sub-pixels, the memories each being one of the plurality of memories in the corresponding sub-pixel.

DETAILED DESCRIPTION

Figure 1:
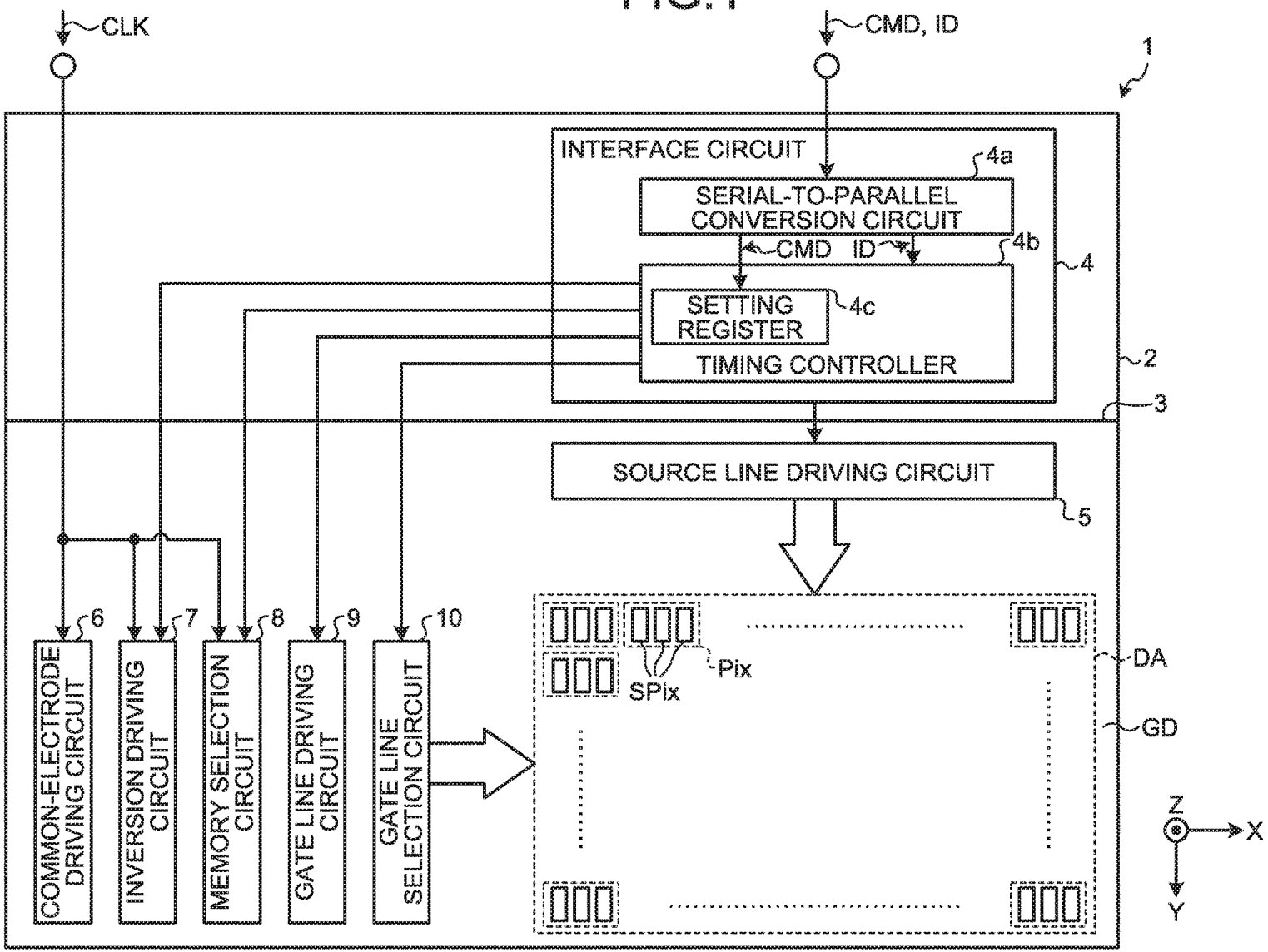
FIG. 1 illustrates an outline of the entire configuration of a display device in an embodiment.

Modes (embodiments) for carrying out the present invention are described hereinbelow in detail with reference to the drawings. Descriptions of the following embodiments are not intended to limit the present invention. The constituent elements described below include those readily apparent to the skilled person or substantially the same. Any two or more of the constituent elements described below can be used in combination as appropriate. What is disclosed herein is merely exemplary, and modifications made without departing from the spirit of the invention and readily apparent to the skilled person naturally fall within the scope of the present invention. The widths, the thicknesses, the shapes, or the like of certain devices in the drawings may be illustrated not-to-scale, for illustrative clarity. However, the drawings are merely exemplary and not intended to limit interpretation of the present invention. Throughout the description and the drawings, the same elements as those already described with reference to the drawing already referred to are assigned the same reference signs, and detailed descriptions thereof are omitted as appropriate.

In this disclosure, when an element is described as being "on" another element, the element can be directly on the other element, or there can be one or more elements between the element and the other element.

Embodiment

1. Entire Configuration

FIG. 1 illustrates an outline of the entire configuration of a display device 1 in an embodiment. The display device 1 includes a first panel 2 and a second panel 3 disposed facing the first panel 2. The display device 1 has a display region DA on which images are displayed, and a frame region GD outside of the display region DA. In the display region DA, a liquid crystal layer is enclosed between the first panel 2 and the second panel 3.

While the display device 1 is a liquid crystal display device including a liquid crystal layer in the embodiment, the present disclosure is not limited to this example. The display device 1 may be an organic electro-luminescence (EL) display device including organic EL elements in place of a liquid crystal layer.

In the display region DA, a plurality of pixels Pix are disposed in a matrix of N columns (where N is a natural number) and M rows (where M is a natural number). The N columns are arranged in the X direction parallel to the respective principal planes of the first panel 2 and the second panel 3. The M rows are arranged in the Y direction. The Y direction is parallel to the respective principal planes of the first panel 2 and the second panel 3 and intersects the X direction. In the frame region GD, an interface circuit 4, a source line driving circuit 5, a common-electrode driving circuit 6, an inversion driving circuit 7, a memory selection circuit 8, a gate line driving circuit 9, and a gate line selection circuit 10 are disposed. Another configuration can be employed in which, while the interface circuit 4, the source line driving circuit 5, the common-electrode driving circuit 6, the inversion driving circuit 7, the memory selection circuit 8 of the foregoing circuits are integrated into an integrated circuit (IC) chip, the gate line driving circuit 9 and the gate line selection circuit 10 are provided on the first panel. Still another configuration can be employed in which a group of such circuits integrated into an IC chip is provided in a processor external to the display device 1 and is coupled to the display device 1.

Each of the M×N pixels Pix has a plurality of sub-pixels SPix. While these sub-pixels SPix are three pixels of R (red), G (green), and B (blue) in the embodiment, the present disclosure is not limited to this example. These sub-pixels SPix may be four sub-pixels of colors including W (white) in addition to R (red), G (green), and B (blue). Alternatively, these sub-pixels SPix may be five or more sub-pixels of different colors.

In the embodiment, these sub-pixels SPix are three sub-pixels, and the total number of sub-pixels SPix disposed in the display region DA is accordingly M×N×3. In the embodiment, three sub-pixels SPix in each of the M×N pixels Pix are disposed in the X direction, and the total number of sub-pixels SPix disposed in any one of the rows included in the M×N pixels Pix is accordingly N×3.

Each of the sub-pixels SPix includes a plurality of memories. While these memories are three memories that are a first memory to a third memory in this embodiment, the present disclosure is not limited to this example. These memories may be two memories or may be four or more memories.

In the embodiment, the plurality of memories are three memories, and the total number of memories disposed in the display region DA is accordingly M×N×3×3. In the embodiment, each of the sub-pixels SPix includes three memories, and the total number of memories disposed in any one of the rows included in the M×N pixels Pix is accordingly N×3×3.

Each of the sub-pixels SPix performs display thereof based on sub-pixel data stored in one memory selected from the first memory, the second memory, and the third memory. That is, a set of M×N×3×3 memories included in the M×N×3 sub-pixels SPix is equivalent to three frame memories.

The interface circuit 4 includes a serial-to-parallel conversion circuit 4*a* and a timing controller 4*b*. The timing controller 4*b* includes a setting register 4*c*. The serial-to-parallel conversion circuit 4*a* is supplied with command data CMD and image data ID as serial data from an external circuit. While the external circuit is exemplified by a host central processing unit (CPU) or an application processor, the present disclosure is not limited to these examples.

The serial-to-parallel conversion circuit 4*a* converts the command data CMD supplied thereto into parallel data and outputs the parallel data to the setting register 4*c*. The setting register 4*c* has values therein set based on the command data CMD. The values are used for controlling the source line driving circuit 5, the inversion driving circuit 7, the memory selection circuit 8, the gate line driving circuit 9, and the gate line selection circuit 10.

The serial-to-parallel conversion circuit 4*a* converts the image data ID supplied thereto into parallel data and outputs the parallel data to the timing controller 4*b*. Based on the set values in the setting register 4*c*, the timing controller 4*b* outputs the image data ID to the source line driving circuit 5. Based on the set values in the setting register 4*c*, the timing controller 4*b* controls the inversion driving circuit 7, a memory selection circuit 8, the gate line driving circuit 9, and the gate line selection circuit 10.

The common-electrode driving circuit 6, the inversion driving circuit 7, and the memory selection circuit 8 are supplied with a reference clock signal CLK from an external circuit. While the external circuit is exemplified by a clock generator, the present disclosure is not limited to this example.

Known driving methods for preventing a screen burn-in in a liquid crystal display device include a common inversion driving method, a column inversion driving method, a line inversion driving method, a dot inversion driving method, and a frame inversion driving method.

The display device 1 can employ any one of the driving methods listed above. In the embodiment, the display device 1 employs the common inversion driving method. The display device 1 employs the common inversion driving method; accordingly, the common-electrode driving circuit 6 inverts the potential (common potential) of a common electrode in synchronization with the reference clock signal CLK. Under the control of the timing controller 4*b*, the inversion driving circuit 7 inverts the potentials of sub-pixel electrodes in synchronization with the reference clock signal CLK. Thus, the display device 1 can implement the common inversion driving method. In the embodiment, the display device 1 is a normally-black liquid crystal display device that displays black without the application of voltage to the liquid crystal and displays white with the application of voltage to the liquid crystal. A normally-black liquid crystal display device displays black when the potential of the sub-pixel electrode and the common potential are in phase with each other, and displays white when the potential of the sub-pixel electrode and the common potential are not in phase with each other.

The reference clock signal CLK corresponds to a referential signal in the present disclosure.

In order to display an image on the display device 1, it is necessary to have the sub-pixel data stored in the first memories to the third memories in the respective sub-pixels SPix. Under the control of the timing controller 4*b*, the gate line driving circuit 9 outputs a gate signal for selecting one of the rows included in the M×N pixels Pix so that the sub-pixel data can be stored in these individual memories.

In a MIP-type liquid crystal display device in which each sub-pixel includes one memory, one gate line is disposed for each row (pixel row (sub-pixel row)). In the embodiment, however, each of the sub-pixels SPix includes three memories that are the first memory to the third memory. For this reason, three gate lines are disposed for each row in the embodiment. The respective three gate lines are electrically coupled to the first memory to the third memory in each of the sub-pixels SPix included in the one row. In a configuration such that each of the sub-pixels SPix is configured to operate in accordance with a gate signal and an inverted gate signal obtained by inverting the gate signal, six gate lines are disposed for each row.

The three or six gate lines disposed for each row correspond to a gate line group in the present disclosure. In the embodiment, the display device 1 includes the pixels Pix disposed in M rows, and M gate line groups are accordingly disposed.

The gate line driving circuit 9 includes M output terminals corresponding to the M rows of pixels Pix. Under the control of the timing controller 4*b*, the gate line driving circuit 9 sequentially outputs, from each of the M output terminals, the gate signal serving a signal for selecting one of the M rows.

Under the control of the timing controller 4*b*, the gate line selection circuit 10 selects one of the three gate lines disposed for each row. Thus, the gate signal output from the gate line driving circuit 9 is supplied to the selected one of the three gate lines disposed with respect to the one row.

Under the control of the timing controller 4*b*, the source line driving circuit 5 outputs the sub-pixel data to memories selected in accordance with the gate signal. Thus, the corresponding sub-pixel data is sequentially stored in the first memory to the third memory in each of the sub-pixels.

The display device 1 performs line sequential scanning on the M rows of pixels Pix to have the sub-pixel data as frame data for one frame stored in the respective first memories in the sub-pixels SPix. The display device 1 performs line sequential scanning three times to have the frame data for three frames stored in the first memory to the third memory in each of the sub-pixels SPix.

For the same effect, the display device 1 can alternatively employs another procedure in which corresponding data are written into the first memories, into the second memories, and into the third memories when each of the rows is scanned. When this scanning is performed on the individual first to M-th rows, the sub-pixel data in the first memories to the third memories in the respective sub-pixels SPix can be stored through line sequential scanning performed only one time.

In the embodiment, three memory selection lines are disposed for each row. The three memory selection lines are electrically coupled to the first to the third memories, respectively, in each of the sub-pixels SPix included in the one row. In a configuration such that each of the sub-pixels SPix is configured to operate in accordance with a memory selection signal and an inverted memory selection signal obtained by inverting the memory selection signal, six memory selection lines are disposed for each row.

The three or six memory selection lines disposed for each row correspond to a memory selection line group in the present disclosure. In the embodiment, the display device 1 includes the pixels Pix disposed in M rows, and M memory selection line groups are accordingly disposed.

Under the control of the timing controller 4*b*, the memory selection circuit 8 simultaneously selects the first memories, the second memories, or the third memories in the respective sub-pixels SPix in synchronization with the reference clock signal CLK. More specifically, the first memories in all of the sub-pixels SPix are simultaneously selected. Otherwise, the second memories in all of the sub-pixels SPix are simultaneously selected. Otherwise, the third memories in all of the sub-pixels SPix are simultaneously selected. Consequently, the display device 1 can display one among three images by switching selection of a memory from one to another among the first memory to the third memory in each of the sub-pixels SPix. Thus, the display device 1 can change the entire image simultaneously and quickly. The display device 1 enables animation display (moving image display) by sequentially switching selection of a memory from one to another among the first memory to the third memory in each of the sub-pixels SPix.

2. Sectional Structure

Figure 2:
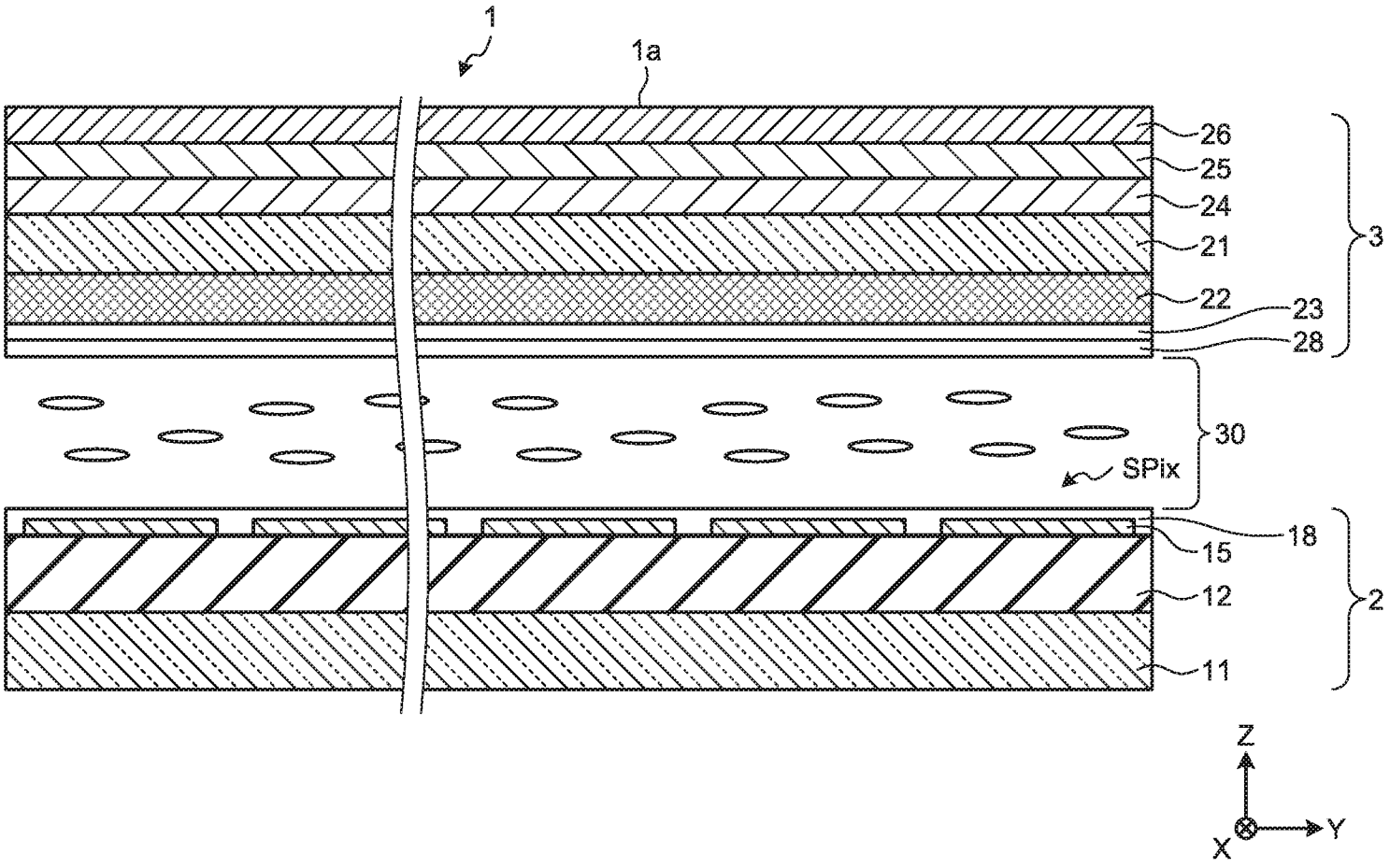
FIG. 2 is a sectional view of the display device in the embodiment.

FIG. 2 is a sectional view of the display device 1 in the embodiment. As illustrated in FIG. 2, the display device 1 includes the first panel 2, the second panel 3, and a liquid crystal layer 30. The second panel 3 is disposed facing the first panel 2. The liquid crystal layer 30 is interposed between the first panel 2 and the second panel 3. One surface of the second panel 3 serving as the principal plane thereof is a display surface 1*a*.

Light incident on the display surface 1*a* from the outside thereof is reflected by reflective electrodes 15 and exits from the display surface 1*a*. The display device 1 in the embodiment is a reflective liquid crystal display device that displays an image on the display surface 1*a* using this reflected light. In the present description, one direction parallel to the display surface 1*a* is set as the X direction, and a direction extending on a plane parallel to the display surface 1*a* and intersecting the X direction is set as the Y direction. A direction perpendicular to the display surface 1*a* is set as the Z direction.

The first panel 2 includes a first substrate 11, an insulating layer 12, the reflective electrodes 15, and an orientation film 18. The first substrate 11 is exemplified by a glass substrate or a resin substrate. On a surface of the first substrate 11, circuit elements and wiring of various kinds such as gate lines and data lines are mounted, which are not illustrated. Switching elements such as thin film transistors (TFTs) and capacitive elements are included among the circuit elements.

The insulating layer 12 is provided on the first substrate 11 to flat the surfaces of the circuit elements and the wiring of various kinds as a whole. The plurality of reflective electrodes 15 are provided on the insulating layers 12. The orientation film 18 is interposed between the reflective electrodes 15 and the liquid crystal layer 30. The reflective electrodes 15 each having a rectangular shape are provided corresponding to the sub-pixels SPix. The reflective electrodes 15 are formed of metal exemplified by aluminum (Al) or silver (Ag). The reflective electrodes 15 may have a configuration stacked with such a metal material and a translucent conductive material exemplified by indium tin oxide (ITO). The reflective electrodes 15 are formed of a material having favorable reflectance, thereby functioning as a reflective plate that reflects light incident from the outside.

After being reflected by the reflective electrodes 15, the light travels in a uniform direction toward the display surface 1*a* although being diffusely reflected and scattered. Change in level of voltage applied to each of the reflective electrodes 15 causes change in the state of light transmission through the liquid crystal layer 30 on that reflective electrode, that is, the state of light transmission of the corresponding sub-pixel. In other words, the respective reflective electrodes 15 also function as sub-pixel electrodes.

The second panel 3 includes a second substrate 21, a color filter 22, a common electrode 23, an orientation film 28, a quarter wavelength plate 24, a half wavelength plate 25, and a polarization plate 26. The color filter 22 and the common electrode 23 are disposed in this order on one of the two opposite surfaces of the second substrate 21, the one surface facing the first panel 2. The orientation film 28 is interposed between the common electrode 23 and the liquid crystal layer 30. The quarter wavelength plate 24, the half wavelength plate 25, and the polarization plate 26 are stacked in this order on a surface of the second substrate 21, the surface facing the display surface 1*a*.

The second substrate 21 is exemplified by a glass substrate or a resin substrate. The common electrode 23 is formed of a translucent conductive material exemplified by ITO. The common electrode 23 is disposed facing the plurality of reflective electrodes 15 and supplies a common potential to the sub-pixels SPix. While the color filter 22 is exemplified as including filters for three colors of R (red), G (green), and B (blue), the present disclosure is not limited to this example.

The liquid crystal layer 30 is exemplified as containing nematic liquid crystal. In the liquid crystal layer 30, the change in the voltage level between the common electrode 23 and each of the reflective electrodes 15 changes an orientation state of liquid crystal molecules. Light transmitted through the liquid crystal layer 30 is thus modulated on a sub-pixel SPix basis.

Ambient light or the like serves as incident light that is incident on the display surface 1*a* of the display device 1, and reaches the reflective electrodes 15 after being transmitted through the second panel 3 and the liquid crystal layer 30. The incident light is reflected by the reflective electrodes 15 for the respective sub-pixels SPix. The light thus reflected is modulated on a sub-pixel SPix basis and exits from the display surface 1*a*. An image is thereby displayed.

3. Circuit Configuration

Figure 3:
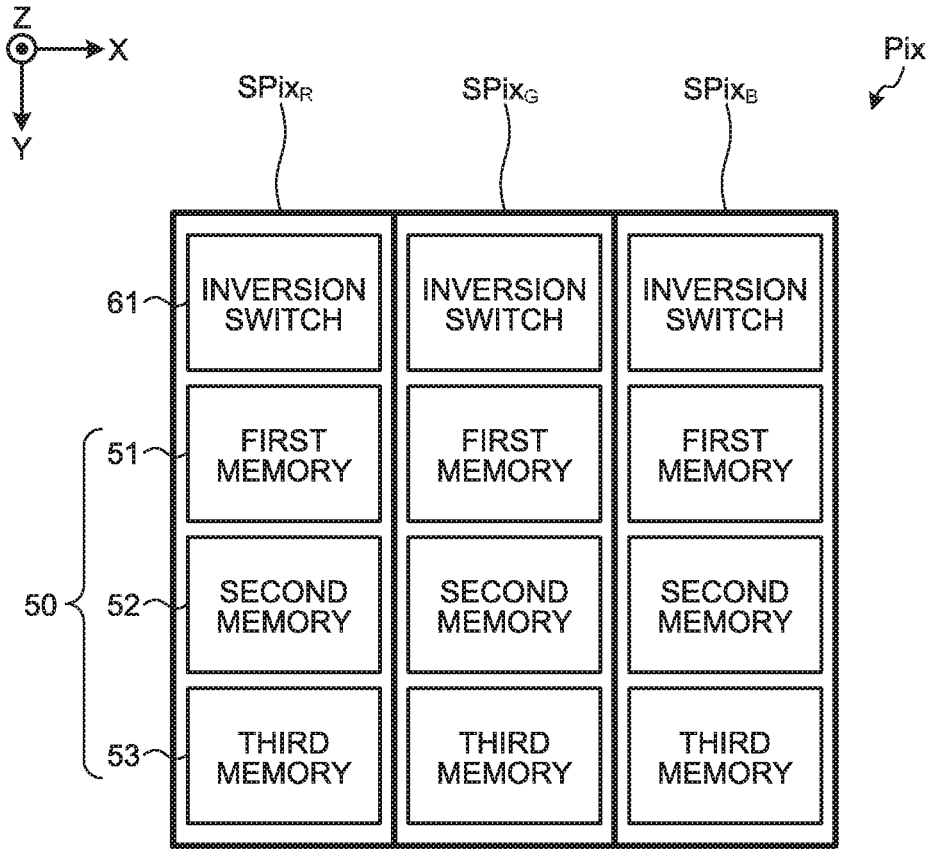
FIG. 3 illustrates an arrangement of sub-pixels in a pixel of the display device in the embodiment.

FIG. 3 illustrates an arrangement of sub-pixels SPix in each pixel Pix of the display device 1 in the embodiment. The pixel Pix includes the sub-pixel $SPix_R$ for R (red), the sub-pixel $SPix_G$ for G (green), and the sub-pixel $SPix_B$ for B (blue). The sub-pixels $SPix_R$, $SPix_G$, and $SPix_B$ are arranged in the X direction.

The sub-pixel $SPix_R$ includes a memory block 50 and an inversion switch 61. The memory block 50 includes a first memory 51, a second memory 52, and a third memory 53. The inversion switch 61, the first memory 51, the second memory 52, and the third memory 53 are arranged in the Y direction.

While the first memory 51 the second memory 52, and the third memory 53 are each described herein as a memory cell that stores therein one-bit data, the present disclosure is not limited to this example. Each of the first memory 51, the second memory 52, and the third memory 53 may be a memory cell that stores therein data of two or more bits.

The inversion switch 61 is electrically coupled to between the sub-pixel electrode (reflective electrode) 15 (see FIG. 2) and the first, second, and third memories 51, 52, and 53. Based on a display signal that is supplied from the inversion driving circuit 7 and inverts in synchronization with the reference clock signal CLK, the inversion switch 61 inverts the sub-pixel data output from a selected one of the first memory 51, the second memory 52, and the third memory 53 on a certain cycle, and outputs the inverted or non-inverted sub-pixel data to the sub-pixel electrode 15.

The display signal inverts in the same cycle as that in which the potential (common potential) of the common electrode 23 inverts.

The inversion switch 61 corresponds to a switch circuit in the present disclosure.

Figure 4:
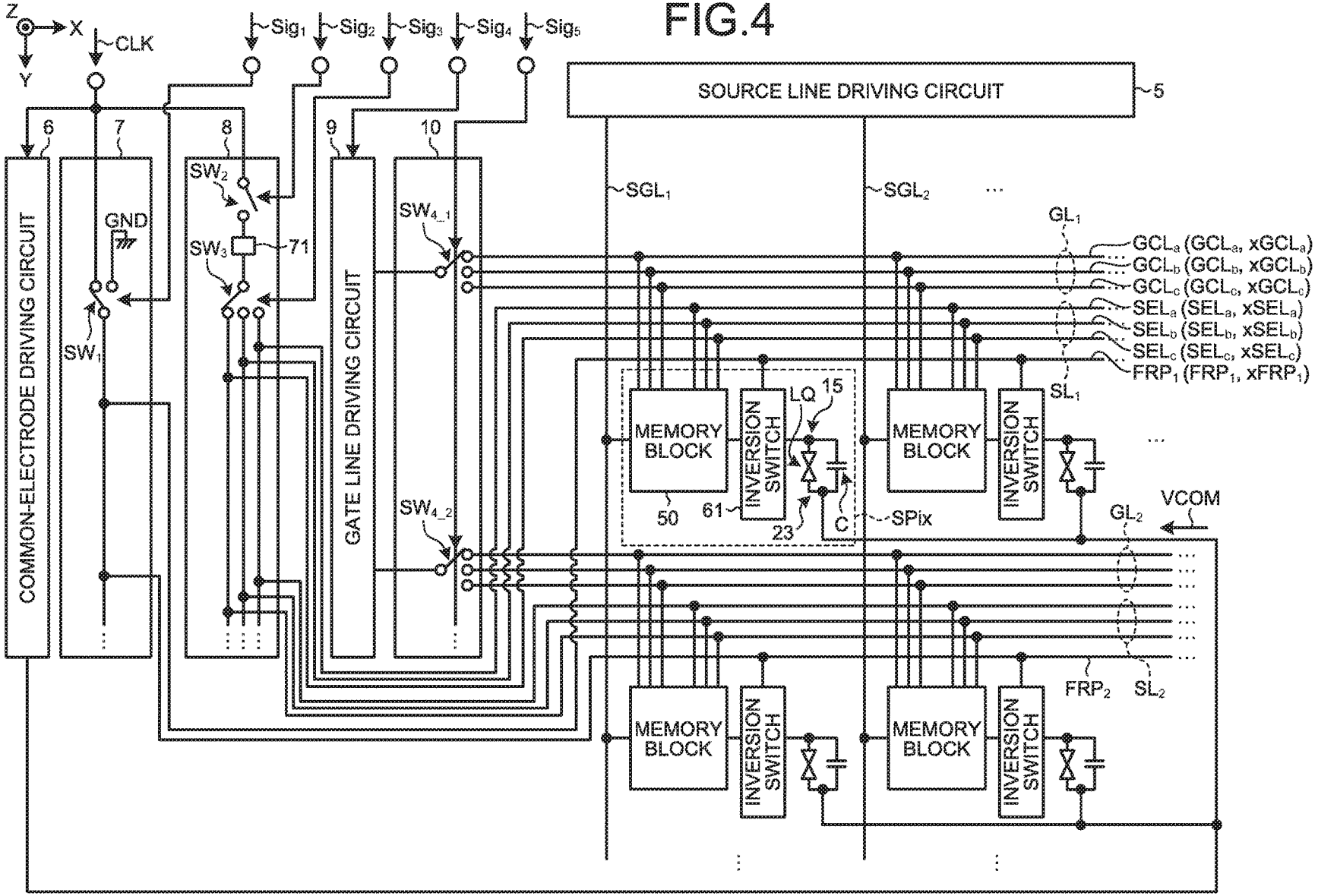
FIG. 4 illustrates a circuit configuration of the display device in the embodiment.

FIG. 4 illustrates a circuit configuration of the display device 1 in the embodiment. FIG. 4 illustrates the sub-pixels SPix in a 2-by-2 matrix among the sub-pixels SPix.

Each of the sub-pixels SPix includes, in addition to the memory block 50 and the inversion switch 61, liquid crystal LQ, a holding capacitance C, and the sub-pixel electrode (reflective electrode) 15 (see FIG. 2).

The common-electrode driving circuit 6 inverts a common potential VCOM common to the sub-pixels SPix in synchronization with the reference clock signal CLK, and outputs the inverted or non-inverted common potential Vcom to the common electrode 23 (see FIG. 2). The common-electrode driving circuit 6 may output the reference clock signal CLK as it is, as the common potential VCOM, to the common electrode 23 or may output the reference clock signal CLK, as the common potential VCOM, to the common electrode 23 via a buffer circuit that amplifies a current driving capability.

The gate line driving circuit 9 includes M output terminals corresponding to the M rows of pixels Pix. Based on a control signal $Sig_4$ supplied from the timing controller 4*b*, the gate line driving circuit 9 sequentially outputs, from each of the M output terminals, the gate signal serving as a signal for selecting one of the M rows.

The gate line driving circuit 9 may be a scanner circuit that, based on control signals $Sig_4$ (a scan start signal and a clock pulse signal), sequentially outputs the gate signal from each of the M output terminals. Alternatively, the gate line driving circuit 9 may be a decoder circuit that decodes the control signals $Sig_4$ that have been encoded and outputs the gate signal to an output terminal designated by the control signals $Sig_4$.

The gate line selection circuit 10 includes M switches $SW_{4_1}$, $SW_{4_2}$ . . . corresponding to the M rows of pixels Pix. The M switches $SW_{4_1}$, $SW_{4_2}$ . . . are uniformly controlled in accordance with a control signal $Sig_5$ supplied from the timing controller 4*b*.

On the first panel 2, M gate line groups $GL_1$, $GL_2$, are disposed corresponding to the M rows of pixels Pix. Each of the M gate line groups $GL_1$, $GL_2$, . . . includes a first gate line $GCL_a$, a second gate line $GCL_b$ and a third gate line $GCL_c$. The first gate line $GCL_a$ is electrically coupled to the first memories 51 (see FIG. 3) of the corresponding row, the second gate line $GCL_b$ electrically coupled to the second memories 52 (see FIG. 3) thereof, and the third gate line $GCL_c$ is electrically coupled to the third memories 53 (see FIG. 3) thereof. Each of the M gate line groups $GL_1$, $GL_2$, is parallel to the X direction in the display region DA (see FIG. 1).

Each of the M switches $SW_{4_1}$, $SW_{4_2}$, . . . electrically couples the corresponding output terminal of the gate line driving circuit 9 to the corresponding first gate line $GCL_a$ when the control signal $Sig_5$ represents a first value. Each of the M switches $SW_{4_1}$, $SW_{4_2}$, . . . electrically couples the corresponding output terminal of the gate line driving circuit 9 to the corresponding second gate line $GCL_b$ when the control signal $Sig_5$ represents a second value. Each of the M switches $SW_{4_1}$, $SW_{4_2}$, . . . , electrically couples the corresponding output terminal of the gate line driving circuit 9 and the corresponding third gate line $GCL_c$ when the control signal $Sig_5$ represents a third value.

When the output terminal of the gate line driving circuit 9 and the corresponding first gate line $GCL_a$ is electrically coupled together, the gate signal is supplied to the first memories 51 of the corresponding sub-pixels SPix. When the output terminal of the gate line driving circuit 9 and the second gate line $GCL_b$ is electrically coupled together, the gate signal is supplied to the second memories 52 of the corresponding sub-pixels SPix. When the output terminal of the gate line driving circuit 9 and the corresponding third gate line $GCL_c$ is electrically coupled together, the gate signal is supplied to the third memories 53 of the corresponding sub-pixels SPix.

On the first panel 2, N×3 source lines $SGL_1$, $SGL_2$, are disposed corresponding to the N×3 columns of sub-pixels SPix. Each of the source lines $SGL_1$, $SGL_2$, . . . is parallel to the Y direction in the display region DA (see FIG. 1). The source line driving circuit 5 outputs the sub-pixel data to one of the three memories in each of the sub-pixels Spix through a corresponding one of the source lines $SGL_1$, $SGL_2$, . . . , the one memory having been selected by being supplied with a gate signal.

In accordance with the gate line GCL that has the gate signal supplied thereto, each of the sub-pixels SPix that belong to one row to which the gate signal has been supplied stores sub-pixel data in one memory among the first memory 51 to the third memory 53, the sub-pixel data having been supplied through the corresponding source line SGL.

The memory selection circuit 8 includes a switch $SW_2$, a latch 71, and another switch $SW_3$. The switch $SW_2$ is controlled by a control signal $Sig_2$ supplied from the timing controller 4*b*.

The following describes operation to be performed when an image is displayed, more specifically, operation to be performed when image data is read out from the M×N×3 first memories 51, the M×N×3 second memories 52, or the M×N×3 third memories 53. In this operation, the timing controller 4*b* outputs the control signal $Sig_2$ representing the first value to the switch $SW_2$. The switch $SW_2$ is turned on based on the control signal $Sig_2$ representing the first value and supplied from the timing controller 4*b*. The reference clock signal CLK is thereby supplied to the latch 71.

The following describes operation to be performed when no image is displayed, more specifically, when no image data is read out from the M×N×3 first memories 51, the M×N×3 second memories 52, and the M×N×3 third memories 53. In this operation, the timing controller 4*b* outputs the control signal $Sig_2$ representing the second value to the switch $SW_2$. The switch $SW_2$ is turned off based on the control signal $Sig_2$ representing the second value and supplied from the timing controller 4*b*. The reference clock signal CLK is thereby kept from being supplied to the latch 71.

When the reference clock signal CLK is supplied to the latch 71 with the switch $SW_2$ on, the latch 71 holds the high level of the reference clock signal CLK for one cycle of the reference clock signal CLK. When the reference clock signal CLK is not supplied to the latch 71 with the switch $SW_2$ off, the latch 71 holds the high level thereof.

On the first panel 2, M memory selection line groups $SL_1$, $SL_2$, . . . are disposed corresponding to the M rows of pixels Pix. Each of the M memory selection line group $SL_1$, $SL_2$, . . . includes: a first memory selection line $SEL_a$, a second memory selection line $SEL_b$, and a third memory selection line $SEL_c$. The first memory selection line $SEL_a$ is electrically coupled to the first memories 51 of the corresponding row, the second memory selection line $SEL_b$ is electrically coupled to the second memories 52 thereof, and the third memory selection line $SEL_c$ is electrically coupled to the third memories 53 thereof. Each of the M memory selection line groups $SL_1$, $SL_2$, . . . is parallel to the X direction in the display region DA (see FIG. 1).

The switch $SW_3$ is controlled by a control signal $Sig_3$ supplied from the timing controller 4*b*. The switch $SW_3$ electrically couples the output terminal of the latch 71 to the first memory selection lines $SEL_a$ in the respective M memory selection line groups $SL_1$, $SL_2$, . . . when the control signal $Sig_3$ represents the first value. The switch $SW_3$ electrically couples the output terminal of the latch 71 to the second memory selection lines $SEL_b$ in the respective M memory selection line groups $SL_1$, $SL_2$, . . . when the control signal $Sig_3$ represents the second value. The switch $SW_3$ electrically couples the output terminal of the latch 71 to the third memory selection lines $SEL_c$ in the respective M memory selection line groups $SL_1$, $SL_2$, . . . when the control signal $Sig_3$ represents the third value.

Each of the sub-pixels SPix modulates the liquid crystal layer based on the sub-pixel data stored in one memory among the first memory 51 to the third memory 53 corresponding to the memory selection line SEL to which a memory selection signal is supplied. Consequently, an image (frame) is displayed on the display surface.

On the first panel 2, M display signal lines $FRP_1$, $FRP_2$, . . . are disposed corresponding to the M rows of pixels Pix. Each of the M display signal lines $FRP_1$, $FRP_2$, extends in the X direction in the display region DA (see FIG. 1). In a configuration such that the inversion switch 61 operates based not only on a display signal but also on an inverted display signal obtained by inverting the display signal, the display signal line FRP and the second display signal line xFRP are disposed for each row.

The one or two display signal lines disposed for each row correspond to a display signal line in the present disclosure.

The inversion driving circuit 7 includes a switch $SW_1$. The switch $SW_1$ is controlled by a control signal $Sig_1$ supplied from the timing controller 4*b*. The switch $SW_1$ supplies the reference clock signal CLK to the display signal lines $FRP_1$, $FRP_2$, . . . when the control signal $Sig_1$ represents the first value. The potential of the electrodes 15 is thereby inverted in synchronization with the reference clock signal CLK. The switch $SW_1$ supplies the reference potential (ground potential) GND to the display signal lines $FRP_1$, $FRP_2$, . . . when the control signal $Sig_1$ represents the second value.

Figure 5:
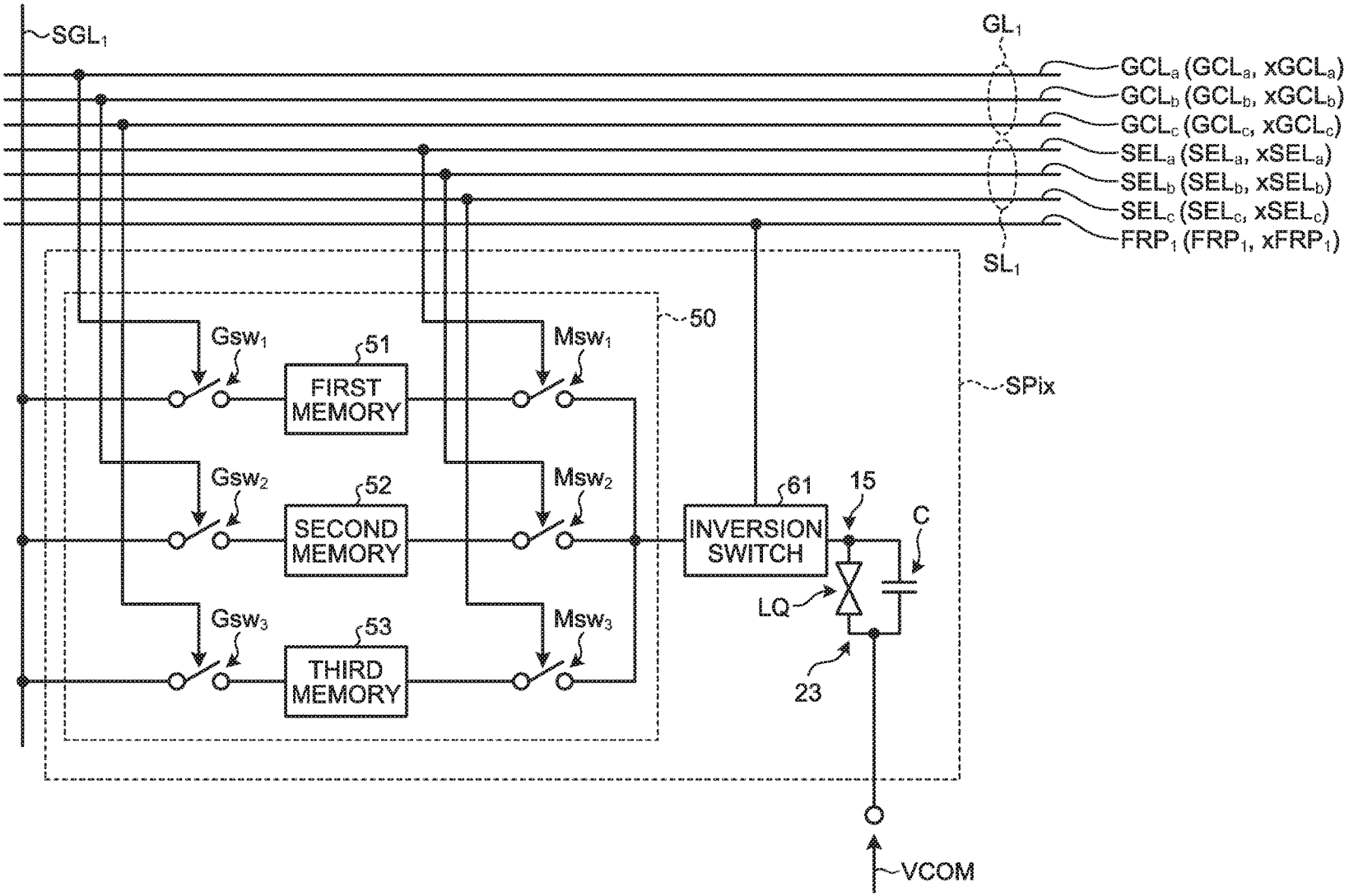
FIG. 5 illustrates a circuit configuration of the sub-pixel of the display device in the embodiment.

FIG. 5 illustrates a circuit configuration of the sub-pixel SPix of the display device 1 in the embodiment. FIG. 5 illustrates one of the sub-pixels SPix.

The sub-pixel SPix includes the memory block 50. The memory block 50 includes the first memory 51, the second memory 52, the third memory 53, switches $Gsw_1$ to $Gsw_3$, and switches $Msw_1$ to $Msw_3$.

A control input terminal of the switch $Gsw_1$ is electrically coupled to the first gate line $GCL_a$. When a high-level gate signal is supplied to the first gate line $GCL_a$, the switch $Gsw_1$ is turned on to electrically couple the source line $SGL_1$ to an input terminal of the first memory 51. Thus, the sub-pixel data supplied to the source line $SGL_1$ is stored in the first memory 51.

A control input terminal of the switch $Gsw_2$ is electrically coupled to the second gate line $GCL_b$. When a high-level gate signal is supplied to the second gate line $GCL_b$, the switch $Gsw_2$ is turned on to electrically couple the source line $SGL_1$ to an input terminal of the second memory 52. Thus, the sub-pixel data supplied to the source line $SGL_1$ is stored in the second memory 52.

A control input terminal of the switch $Gsw_3$ is electrically coupled to the third gate line $GCL_c$. When a high-level gate signal is supplied to the third gate line $GCL_c$, the switch $Gsw_3$ is turned on to electrically couple the source line $SGL_1$ to an input terminal of the third memory 53. Thus, the sub-pixel data supplied to the source line $SGL_1$ is stored in the third memory 53.

In a configuration such that the switches $Gsw_1$ to $Gsw_3$ operate with a high-level gate signal, the gate line group $GL_1$ includes the first gate line $GCL_a$ to the third gate line $GCL_c$ as illustrated in FIG. 5. While a switch that operates based on a high-level gate signal is exemplified by an N-channel transistor, the present disclosure is not limited thereto.

In contrast, in a configuration such that each of the switches $Gsw_1$ to $Gsw_3$ operate based not only on the gate signal but also on an inverted gate signal obtained by inverting the gate signal, the gate line group $GL_1$ includes not only the first gate line $GCL_a$ to the third gate line $GCL_c$ but also fourth gate line $xGCL_a$ to sixth gate line $xGCL_c$ to each of which the inverted gate signal is supplied. While a switch that operates based on a gate signal and an inverted gate signal is exemplified by a transfer gate, the present disclosure is not limited thereto.

The inverted gate signal can be supplied to the fourth gate line $xGCL_a$ when the display device 1 includes an inverter circuit that has an input terminal and an output terminal electrically coupled to the first gate line $GCL_a$ and to the fourth gate line $xGCL_a$, respectively. Likewise, the inverted gate signal can be supplied to the fifth gate line $xGCL_b$ when the display device 1 includes an inverter circuit that has an input terminal and an output terminal electrically coupled to the second gate line $GCL_b$ and to the fifth gate line $xGCL_b$, respectively. Likewise, the inverted gate signal can be supplied to the sixth gate line $xGCL_c$ when the display device 1 includes an inverter circuit that has an input terminal and an output terminal electrically coupled to the third gate line $GCL_c$ and to the sixth gate line $xGCL_c$, respectively.

A control input terminal of the switch $Msw_1$ is electrically coupled to the first memory selection line $SEL_a$. When a high-level memory selection signal is supplied to the first memory selection line $SEL_a$, the switch $Msw_1$ is turned on and electrically couples the output terminal of the first memory 51 to an input terminal of the inversion switch 61. Thus, the sub-pixel data stored in the first memory 51 is supplied to the inversion switch 61.

A control input terminal of the switch $Msw_2$ is electrically coupled to the second memory selection line $SEL_b$. When a high-level memory selection signal is supplied to the second memory selection line $SEL_b$, the switch $Msw_2$ is turned on and electrically couples the output terminal of the second memory 52 to the input terminal of the inversion switch 61. Thus, the sub-pixel data stored in the second memory 52 is supplied to the inversion switch 61.

A control input terminal of the switch $Msw_3$ is electrically coupled to the third memory selection line $SEL_c$. When a high-level memory selection signal is supplied to the third memory selection line $SEL_c$, the switch $Msw_3$ is turned on and electrically couples the output terminal of the third memory 53 to the input terminal of the inversion switch 61. Thus, the sub-pixel data stored in the third memory 53 is supplied to the inversion switch 61.

In a configuration such that each of the switches $Msw_1$ to $Msw_3$ operate based on a high-level memory selection signal, the memory selection line group $SL_1$ includes the first memory selection line $SEL_a$ to the third memory selection line $SEL_c$ as illustrated in FIG. 5. While a switch that operates based on a high-level gate signal is exemplified by an N-channel transistor, the present disclosure is not limited thereto.

In contrast, in a configuration such that each of the switches $Msw_1$ to $Msw_3$ operate based not only on a memory selection signal but also on an inverted memory selection signal obtained by inverting the memory selection signal, the memory selection line group $SL_1$ includes not only the first memory selection line $SEL_a$ to the third memory selection line $SEL_c$ but also fourth memory selection line $xSEL_a$ to sixth memory selection line $xSEL_c$ to each of which the inverted memory selection signal is supplied. While a switch that operates based on a memory selection signal and an inverted memory selection signal is exemplified by a transfer gate, the present disclosure is not limited thereto.

The inverted memory selection signal can be supplied to the fourth memory selection line $xSEL_a$ when the display device 1 includes an inverter circuit having an input terminal and an output terminal electrically coupled to the first memory selection line $SEL_a$ and to the fourth memory selection line $xSEL_a$, respectively. Likewise, the inverted memory selection signal can be supplied to the fifth memory selection line $xSEL_b$ when the display device 1 includes an inverter circuit having an input terminal and an output terminal electrically coupled to the second memory selection line $SEL_b$ and to the fifth memory selection line $xSEL_b$, respectively. Likewise, the inverted memory selection signal can be supplied to the sixth memory selection line $xSEL_c$ when the display device 1 includes an inverter circuit having an input terminal and an output terminal electrically coupled to the third memory selection line $SEL_c$ and to the sixth memory selection line $xSEL_c$, respectively.

A display signal that inverts in synchronization with the reference clock signal CLK is supplied to the inversion switch 61 from the display signal line $FRP_1$. Based on the display signal, the inversion switch 61 supplies the sub-pixel data stored in the first memory 51 or inverted sub-pixel data obtained by inverting the sub-pixel data to the sub-pixel electrode 15, the second memory 52, and the third memory 53. The liquid crystal LQ and the holding capacitance C are interposed between the sub-pixel electrode 15 and the common electrode 23. The holding capacitance C holds the voltage between the sub-pixel electrode 15 and the common electrode 23. Liquid crystal molecules in the liquid crystal LQ change in orientation depending on the voltage between the sub-pixel electrode 15 and the common electrode 23, so that a sub-pixel image is displayed.

In a configuration such that the inversion switch 61 operates based on a display signal, the single display signal line $FRP_1$ is included as illustrated in FIG. 5. Instead, in a configuration such that the inversion switch 61 operates based not only on a display signal but also on an inverted display signal obtained by inverting the display signal, a second display signal line $xFRP_1$ is included in addition to the display signal line $FRP_1$. Further, an inverter circuit is provided that has an input terminal and an output terminal electrically coupled to the display signal line $FRP_1$ and to the second display signal line $xFRP_1$, respectively. Thus, the inverted display signal can be supplied to the second display signal line $xFRP_1$.

Figure 6:
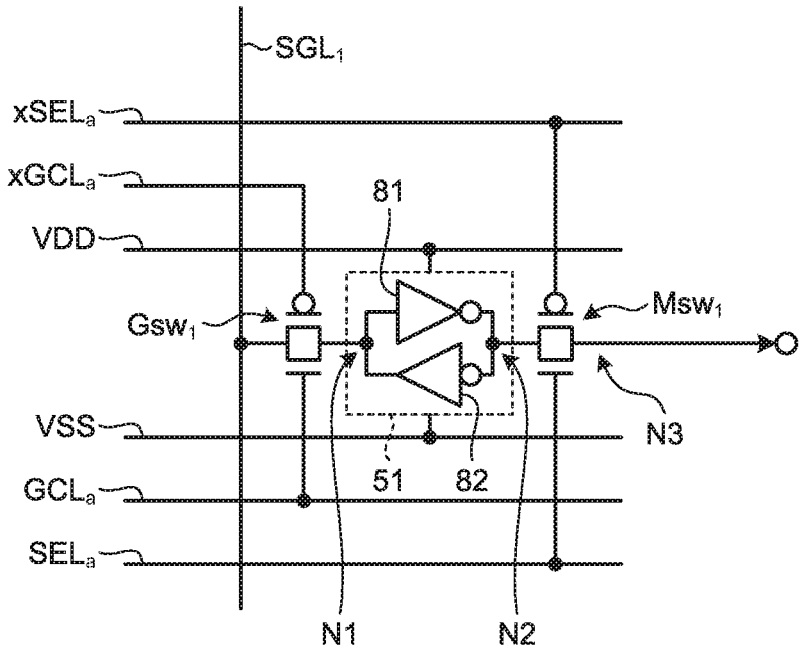
FIG. 6 illustrates a circuit configuration of a memory in the sub-pixel of the display device in the embodiment.

FIG. 6 illustrates a circuit configuration of each memory in the sub-pixel SPix of the display device 1 in the embodiment. FIG. 6 illustrates the circuit configuration of the first memory 51. The circuit configurations of the second memory 52 and the third memory 53 are identical to the circuit configuration of the first memory 51, and illustration and description thereof is therefore omitted.

The first memory 51 has a static random access memory (SRAM) cell structure that includes an inverter circuit 81 and another inverter circuit 82. The inverter circuit 82 is electrically coupled to the inverter circuit 81 in parallel and in a direction opposite to the direction thereof. The input terminal of the inverter circuit 81 and the output terminal of the inverter circuit 82 constitute a node N1, and the output terminal of the inverter circuit 81 and the input terminal of the inverter circuit 82 constitute a node N2. The inverter circuits 81 and 82 operate with power supplied from a high-potential power supply line VDD and a low-potential power supply line VSS.

The node N1 is electrically coupled to the output terminal of the switch $Gsw_1$. The node N2 is electrically coupled to the input terminal of the switch $Msw_1$.

FIG. 6 illustrates an example in which a transfer gate is used as the switch $Gsw_1$. The non-inverting control input terminal of the switch $Gsw_1$ is electrically coupled to the first gate line $GCL_a$. The inverting control input terminal of the switch $Gsw_1$ is electrically coupled to the fourth gate line $xGCL_a$. The fourth gate line $xGCL_a$ is supplied with an inverted gate signal obtained by inverting the gate signal supplied to the first gate line $GCL_a$.

The input terminal of the switch $Gsw_1$ is electrically coupled to the source line $SGL_1$. The output terminal of the switch $Gsw_1$ is electrically coupled to the node N1. When the gate signal supplied to the first gate line $GCL_a$ is high-level and the inverted gate signal supplied to the fourth gate line $xGCL_a$ is low-level, the switch $Gsw_1$ is turned on and electrically couples the source line $SGL_1$ to the node N1. Thus, the sub-pixel data supplied to the source line $SGL_1$ is stored in the first memory 51.

FIG. 6 illustrates an example in which a transfer gate is used as the switch $Msw_1$. The non-inverting control input terminal of the switch $Msw_1$ is electrically coupled to the first memory selection line $SEL_a$. The inverting control input terminal of the switch $Msw_1$ is electrically coupled to the fourth memory selection line $xSEL_a$. The fourth memory selection line $xSEL_a$ is supplied with an inverted memory selection signal obtained by inverting the memory selection signal supplied to the first memory selection line $SEL_a$.

The input terminal of the switch $Msw_1$ is electrically coupled to the node N2. The output terminal of the switch $Msw_1$ is electrically coupled to a node N3. The node N3 is an output node of the first memory 51 and is electrically coupled to the inversion switch 61 (see FIG. 5). When the memory selection signal supplied to the first memory selection line $SEL_a$ is high-level and the inverted memory selection signal supplied to the fourth memory selection line $xSEL_a$ is low-level, the switch $Msw_1$ is turned on. Thus, the node N2 is electrically coupled to the input terminal of the inversion switch 61 via the switch $Msw_1$ and the node N3. Thus, the sub-pixel data stored in the first memory 51 is supplied to the inversion switch 61.

When the switches $Gsw_1$ and $Msw_1$ are both off, the sub-pixel data circulates through a loop formed by the inverter circuits 81 and 82. The first memory 51 consequently keeps holding the sub-pixel data.

While the above description illustrates the first memory 51 as an SRAM in the embodiment, the present disclosure is not limited to this example. Other examples of the first memory 51 include, but are not limited to, a dynamic random access memory (DRAM).

Figure 7:
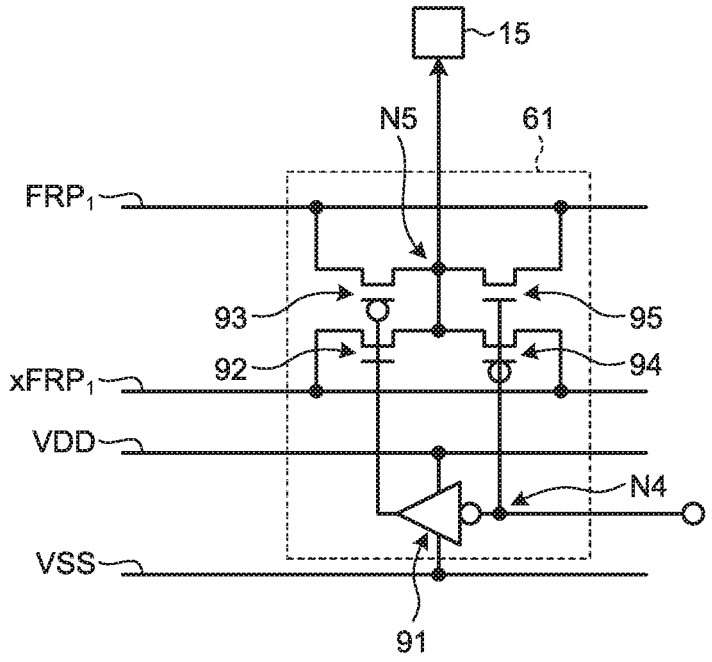
FIG. 7 illustrates a circuit configuration of an inversion switch in the sub-pixel of the display device in the embodiment.

FIG. 7 illustrates a circuit configuration of the inversion switch 61 in the sub-pixel SPix of the display device 1 in the embodiment. The inversion switch 61 includes an inverter circuit 91, N-channel transistors 92 and 95, and P-channel transistors 93 and 94.

The input terminal of the inverter circuit 91, the gate terminal of the P-channel transistor 94, and the gate terminal of the N-channel transistor 95 are coupled to a node N4. The node N4 is an input node for the inversion switch 61 and is electrically coupled to the nodes N3 of the first memory 51, the second memory 52, and the third memory 53. The sub-pixel data is supplied to the node N4 from the first memory 51, the second memory 52, and the third memory 53. The inverter circuit 91 operates with power supplied from the high-potential power supply line VDD and the low-potential power supply line VSS.

One of the source and the drain of the N-channel transistor 92 is electrically coupled to the second display signal line $xFRP_1$. The other one of the source and the drain of the N-channel transistor 92 is electrically coupled to a node N5.

One of the source and the drain of the P-channel transistor 93 is electrically coupled to the display signal line $FRP_1$. The other one of the source and the drain of the P-channel transistor 93 is electrically coupled to the node N5.

One of the source and the drain of the P-channel transistor 94 is electrically coupled to the second display signal line $xFRP_1$. The other one of the source and the drain of the P-channel transistor 94 is electrically coupled to the node N5.

One of the source and the drain of the N-channel transistor 95 is electrically coupled to the display signal line $FRP_1$. The other one of the source and the drain of the N-channel transistor 95 is electrically coupled to the node N5.

The node N5 is the output node of the inversion switch 61 and is electrically coupled to the reflective electrode (sub-pixel electrode) 15.

When the sub-pixel data supplied from the first memory 51, the second memory 52, or the third memory 53 is high-level, an output signal from the inverter circuit 91 is low-level. When an output signal from the inverter circuit 91 is low-level, the N-channel transistor 92 is off and the P-channel transistor 93 is on.

When the sub-pixel data supplied from the first memory 51, the second memory 52, or the third memory 53 is high-level, the P-channel transistor 94 is off and the N-channel transistor 95 is on.

Therefore, when the sub-pixel data supplied from the first memory 51, the second memory 52, or the third memory 53 is high-level, a display signal supplied to the display signal line $FRP_1$ is supplied to the sub-pixel electrode 15 via the P-channel transistor 93 and the N-channel transistor 95.

The display signal supplied to the display signal line $FRP_1$ inverts in synchronization with the reference clock signal CLK. The common potential supplied to the common electrode 23 also inverts, in phase with the display signal, in synchronization with the reference clock signal CLK. When the display signal and the common potential are in phase with each other, no voltage is applied to the liquid crystal LQ, and liquid crystal molecules do not change in orientation. Thus, the sub-pixel displays black (is in a state not transmitting the reflected light, that is, a state not displaying colors with the color filter not transmitting the reflected light). Thus, the display device 1 can implement the common inversion driving method.

When the sub-pixel data supplied from the first memory 51, the second memory 52, or the third memory 53 is low-level, an output signal from the inverter circuit 91 is high-level. When an output signal from the inverter circuit 91 is high-level, the N-channel transistor 92 is on and the P-channel transistor 93 is off.

When the sub-pixel data supplied from the first memory 51, the second memory 52, or the third memory 53 is low-level, the P-channel transistor 94 is on and the N-channel transistor 95 is off.

Therefore, when the sub-pixel data supplied from the first memory 51, the second memory 52, or the third memory 53 is low-level, an inverted display signal supplied to the second display signal line $xFRP_1$ is supplied to the sub-pixel electrode 15 via the P-channel transistor 92 and the N-channel transistor 94.

The inverted display signal supplied to the second display signal line $xFRP_1$ inverts in synchronization with the reference clock signal CLK. Then, viewing from the inverted display signal supplied to the second display signal line $xFRP_1$, the common potential supplied to the common electrode 23 inverts, out of phase with the inveted display signal, in synchronization with the reference clock signal CLK. When the inverted display signal and the common potential are out of phase with each other, voltage is applied to the liquid crystal LQ, and liquid crystal molecules change in orientation. Thus, the sub-pixel displays white (is in a state transmitting the reflected light, that is, a state displaying colors with the color filter transmitting the reflected light). Thus, the display device 1 can implement the common inversion driving method.

Figure 8:
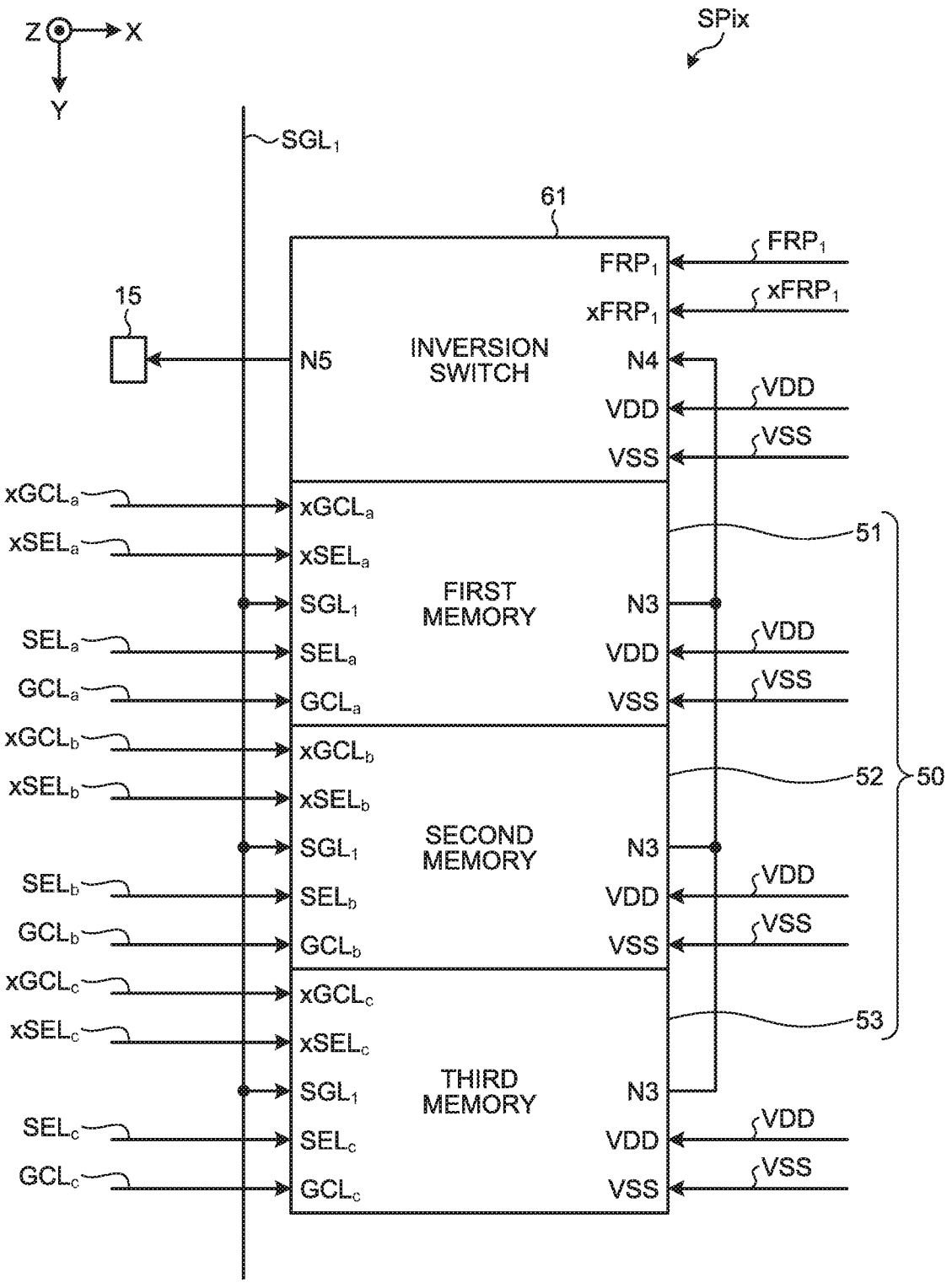
FIG. 8 schematically illustrates a layout in the sub-pixel of the display device in the embodiment.

FIG. 8 schematically illustrates a layout in the sub-pixel SPix of the display device 1 in the embodiment. The inversion switch 61, the first memory 51, the second memory 52, and the third memory 53 are arranged in the Y direction. The nodes N3, which are respective output nodes of the first memory 51, the second memory 52, and the third memory 53, are electrically coupled to the node N4 serving as an input node of the inversion switch 61. The node N5, which is an output node of the inversion switch 61, is electrically coupled to the sub-pixel electrode 15.

The first memory 51 is electrically coupled to the first gate line $GCL_a$, the fourth gate line $xGCL_a$, the first memory selection line $SEL_a$, the fourth memory selection line $xSEL_a$, the source line $SGL_1$, the high-potential power supply line VDD, and the low-potential power supply line VSS.

The second memory 52 is electrically coupled to the second gate line $GCL_b$, the fifth gate line $xGCL_b$, the second memory selection line $SEL_b$, the fifth memory selection line $xSEL_b$, the source line $SGL_1$, the high-potential power supply line VDD, and the low-potential power supply line VSS.

The third memory 53 is electrically coupled to the third gate line $GCL_c$, the sixth gate line $xGCL_c$, the third memory selection line $SEL_c$, the sixth memory selection line $xSEL_c$, the source line $SGL_1$, the high-potential power supply line VDD, and the low-potential power supply line VSS.

The inversion switch 61 is electrically coupled to the display signal line $FRP_1$, the second display signal line $xFRP_1$, the high-potential power supply line VDD, and the low-potential power supply line VSS.

4. Operation

Figure 9:
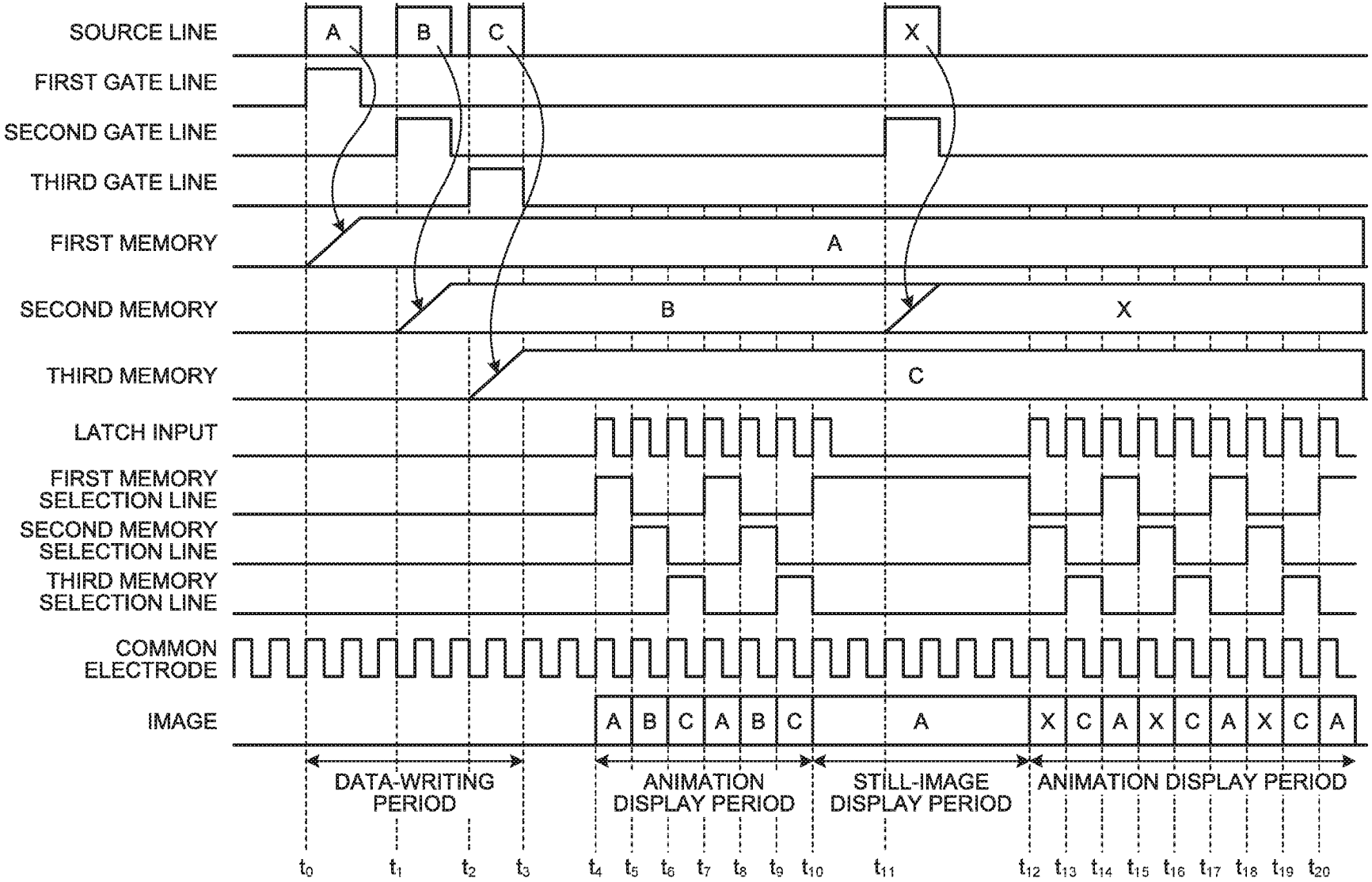
FIG. 9 is a timing chart illustrating operation timings of the display device in the embodiment.

FIG. 9 is a timing chart illustrating operation timings of the display device 1 in the embodiment. Throughout the entire period in FIG. 9, the common-electrode driving circuit 6 supplies, to the common electrode 23, a common potential that inverts in synchronization with the reference clock signal CLK.

A period from the timing $t_0$ to the timing $t_3$ is a period in which to write the sub-pixel data into the first memories 51 to the third memories 53 included in the respective (N×3) sub-pixels SPix that belong to one of the rows.

At the timing $t_0$, the timing controller 4*b* outputs the control signal $Sig_5$ representing the first value to the switch $SW_4$ in the gate line selection circuit 10. The switch $SW_4$ electrically couples the output terminal of the gate line driving circuit 9 to the first gate line $GCL_a$. The gate line driving circuit 9 outputs a gate signal to the first gate line $GCL_a$ of each of the rows. When a high-level gate signal is supplied to the first gate line $GCL_a$, the first memories 51 in the respective sub-pixels SPix that belong to the row are selected as memories into which the sub-pixel data is written.

At the timing $t_0$, the source line driving circuit 5 outputs sub-pixel data for displaying an image (frame) "A" to the source lines SGL. Thus, the sub-pixel data for displaying the image (frame) "A" is written into the individual first memories 51 in the respective sub-pixels SPix that belong to the row.

In a period from the timing $t_0$ to the timing $t_1$, this operation is line-sequentially performed with respect to each of the first to the M-th rows. Thus, signals for forming the image "A" are written into and stored in the first memories in all of the sub-pixels SPix.

At the timing $t_1$, the timing controller 4*b* outputs the control signal $Sig_5$ representing the second value to the switch $SW_4$ in the gate line selection circuit 10. The switch $SW_4$ electrically couples the output terminal of the gate line driving circuit 9 to the second gate line $GCL_b$. The gate line driving circuit 9 outputs a gate signal to the second gate line $GCL_b$ of each of the rows. When a high-level gate signal is supplied to the second gate line $GCL_b$, the second memories 52 in the respective sub-pixels SPix that belong to the row are selected as memories into which the sub-pixel data is written.

At the timing $t_1$, the source line driving circuit 5 outputs sub-pixel data for displaying an image (frame) "B" to the source lines SGL. Thus, the sub-pixel data for displaying the image (frame) "B" is written into the individual second memories 52 in the respective sub-pixels SPix that belong to the row.

In a period from the timing $t_1$ to the timing $t_2$, this operation is line-sequentially performed with respect to each of the first to the M-th rows. Thus, signals for forming the image "B" are written into and stored in the second memories in all of the sub-pixels SPix.

At the timing $t_2$, the timing controller 4*b* outputs the control signal $Sig_5$ representing the third value to the switch $SW_4$ in the gate line selection circuit 10. The switch $SW_4$ electrically couples the output terminal of the gate line driving circuit 9 to the third gate line $GCL_C$. The gate line driving circuit 9 outputs a gate signal to the third gate line $GCL_c$ of each of the rows. When a high-level gate signal is supplied to the third gate line $GCL_{cr}$ the third memories 53 in the respective sub-pixels SPix that belong to the row are selected as memories into which the sub-pixel data is written.

At the timing $t_2$, the source line driving circuit 5 outputs sub-pixel data for displaying an image (frame) "C" to the source lines SGL. Thus, the sub-pixel data for displaying the image (frame) "C" is written into the individual third memories 53 in the respective sub-pixels SPix that belong to the row.

In a period from the timing $t_2$ to the timing $t_3$, this operation is line-sequentially performed with respect to each of the first to the M-th rows. Thus, signals for forming the image "C" are written into and stored in the third memories in all of the sub-pixels SPix.

The display device 1 can write the sub-pixel data of three images "A", "B", and "C" into the first memories 51 to the third memories 53 in the respective sub-pixels SPix by repeating, M times, the same operation as the operation performed from the timing $t_0$ to the timing $t_3$.

A period from the timing $t_4$ to the timing $t_{10}$ is an animation display (moving image display) period in which to sequentially switch an image to be displayed from one image to another among the three images "A", "B", and "C" (three frames).

At the timing $t_4$, the timing controller 4*b* outputs the control signal $Sig_2$ representing the first value to the switch $SW_2$ in the memory selection circuit 8. The switch $SW_2$ is turned on based on the control signal $Sig_2$ representing the first value and supplied from the timing controller 4*b*. Thus, the reference clock signal CLK is supplied to the latch 71.

At the timing $t_4$, the timing controller 4*b* also outputs the control signal $Sig_3$ representing the first value to the switch $SW_3$ in the memory selection circuit 8. The switch $SW_3$ electrically couples the output terminal of the latch 71 to the first memory selection lines $SEL_a$ in the respective M memory selection line groups $SL_1$, $SL_2$, . . . . Thus, the memory selection signal is supplied to the first memory selection lines $SEL_a$ of the respective M memory selection line groups $SL_1$, $SL_2$, . . . .

The first memories 51 coupled to the respective first memory selection lines $SEL_a$ output the sub-pixel data for displaying the image "A" to the corresponding inversion switches 61. Thus, at the timing $t_4$, the display device 1 displays the image "A".

At the timing $t_5$, the timing controller 4*b* outputs the control signal $Sig_2$ representing the first value to the switch $SW_2$ in the memory selection circuit 8. The switch $SW_2$ is turned on based on the control signal $Sig_2$ representing the first value and supplied from the timing controller 4*b*. Thus, the reference clock signal CLK is supplied to the latch 71.

At the timing $t_5$, the timing controller 4*b* also outputs the control signal $Sig_3$ representing the second value to the switch $SW_3$ in the memory selection circuit 8. The switch $SW_3$ electrically couples the output terminal of the latch 71 to the second memory selection line lines $SEL_b$ in the respective M memory selection line groups $SL_1$, $SL_2$, . . . . Thus, the memory selection signal is supplied to the second memory selection lines $SEL_b$ of the respective M memory selection line groups $SL_1$, $SL_2$, . . . .

The second memories 52 coupled to the respective second memory selection lines $SEL_b$ output the sub-pixel data for displaying the image "B" to the corresponding inversion switches 61. Thus, at the timing $t_5$, the display device 1 displays the image "B".

At the timing $t_6$, the timing controller 4*b* outputs the control signal $Sig_2$ representing the first value to the switch $SW_2$ in the memory selection circuit 8. The switch $SW_2$ is turned on based on the control signal $Sig_2$ representing the first value and supplied from the timing controller 4*b*. Thus, the reference clock signal CLK is supplied to the latch 71.

At the timing $t_6$, the timing controller 4*b* also outputs the control signal $Sig_3$ representing the third value to the switch $SW_3$ in the memory selection circuit 8. The switch $SW_3$ electrically couples the output terminal of the latch 71 to the third memory selection lines $SEL_c$ in the respective M memory selection line groups $SL_1$, $SL_2$, . . . . Thus, the memory selection signal is supplied to the third memory selection lines $SEL_c$ of the respective M memory selection line groups $SL_1$, $SL_2$, . . . .

The third memories 53 coupled to the respective third memory selection lines $SEL_c$ output the sub-pixel data for displaying the image "C" to the corresponding inversion switches 61. Thus, at the timing $t_6$, the display device 1 displays the image "C".

Operation that the components perform for a period from the timing $t_7$ to the timing $t_9$ is the same as operation that they perform for a period from the timing $t_4$ to the timing $t_6$. The description thereof is therefore omitted.

As described above, during a period from the timing $t_4$ to the timing $t_{10}$, the display device 1 can provide animation display (moving image display) in which it sequentially switches which image to be displayed from one to another among the three images "A", "B", and "C" (three frames).

A period from the timing $t_{10}$ to the timing $t_{12}$ is a still-image display period in which the image "A" is displayed.

At the timing $t_{10}$, the timing controller 4*b* outputs the control signal $Sig_2$ representing the second value to the switch $SW_2$ in the memory selection circuit 8. The switch $SW_2$ is turned off based on the control signal $Sig_2$ representing the second value and supplied from the timing controller 4*b*. Thus, the reference clock signal CLK is kept from being supplied to the latch 71. The latch 71 holds the high level.

At the timing $t_{10}$, the timing controller 4*b* also outputs the control signal $Sig_3$ representing the first value to the switch $SW_3$ in the memory selection circuit 8. The switch $SW_3$ electrically couples the output terminal of the latch 71 to the first memory selection lines $SEL_a$ in the respective M memory selection line groups $SL_1$, $SL_2$, . . . . The display device 1 displays the image "A" as a still image for a period from the timing $t_{10}$ to the timing $t_{12}$ though driving performed in the same manner as described above.

At the timing $t_{11}$ during the still-image display period for which the image "A" is displayed as a still image, sub-pixel data for displaying an image "X" is written into the second memories 52 in the respective sub-pixels SPix.

At the timing $t_{11}$, the timing controller 4*b* outputs the control signal $Sig_5$ representing the second value to the switch $SW_4$ in the gate line selection circuit 10. The switch $SW_4$ electrically couples the output terminal of the gate line driving circuit 9 to the second gate line $GCL_b$. The gate line driving circuit 9 outputs a gate signal to the second gate line $GCL_b$ of each of the rows. When a high-level gate signal is supplied to the second gate line $GCL_b$, the second memories 52 in the respective sub-pixels SPix that belong to the row are selected as memories into which the sub-pixel data is written.

At the timing $t_{11}$, the source line driving circuit 5 outputs sub-pixel data for displaying an image "X" to the source lines SGL. Thus, the sub-pixel data for displaying the image (frame) "X" is written into the individual second memories 52 in the respective sub-pixels SPix that belong to the row.

The display device 1 can write the sub-pixel data of the image "X" into the second memories 52 in the respective sub-pixels SPix by repeating, M times, the same operation as the operation performed at the timing $t_n$.

FIG. 9 illustrates a case in which, at the timing $t_{11}$ during the still-image display period for which the image "A" is displayed as a still image, the sub-pixel data for displaying the image "X" is written into the second memories 52 in the respective sub-pixels SPix. However, it is also possible to, for example, from the timing $t_6$ to the timing $t_8$ for which the images "C" and "A" are displayed as animations (displayed as moving images) during the animation display (moving image display) period, write the sub-pixel data for displaying the image "X" into the second memories 52 in the respective sub-pixels SPix.

A period after the timing $t_{12}$ is an animation display (moving image display) period in which to sequentially switch which image to be displayed from one to another among the three images "X", "C", and "A" (three frames).

At the timing $t_{12}$, the timing controller 4*b* outputs the control signal $Sig_2$ representing the first value to the switch $SW_2$ in the memory selection circuit 8. The switch $SW_2$ is turned on based on the control signal $Sig_2$ representing the first value and supplied from the timing controller 4*b*. Thus, the reference clock signal CLK is supplied to the latch 71.

At the timing $t_{12}$, the timing controller 4*b* also outputs the control signal $Sig_3$ representing the second value to the switch $SW_3$ in the memory selection circuit 8. The switch $SW_3$ electrically couples the output terminal of the latch 71 to the second memory selection line lines $SEL_b$ in the respective M memory selection line groups $SL_1$, $SL_2$, . . . . Thus, the memory selection signal is supplied to the second memory selection lines $SEL_b$ of the respective M memory selection line groups $SL_1$, $SL_2$, . . . .

The second memories 52 coupled to the respective second memory selection lines $SEL_b$ output the sub-pixel data for displaying the image "X" to the corresponding inversion switches 61. Thus, at the timing $t_{12}$, the display device 1 displays the image "X".

Operation that the components perform for a period from the timing $t_{13}$ to the timing $t_{14}$ is the same as operation that they perform for a period from the timing $t_6$ to the timing $t_7$. The description thereof is therefore omitted.

Operation that the components perform after the timing $t_{15}$ is the same as operation that they perform for a period from the timing $t_{12}$ to the timing $t_{14}$. The description thereof is therefore omitted.

The display device disclosed in JP-A-09-212140 switches a plurality of memories from one to another in each of a plurality of pixels by performing line sequential scanning with scan signals. Therefore, the display device disclosed in JP-A-09-212140 needs a one-frame period to complete the switching for the pluralities of memories for all of the pixels. That is, the display device disclosed in JP-A-09-212140 needs a one-frame period to change an image (frame).

In contrast, the display device 1 in this embodiment is configured such that the memory selection circuit 8 disposed outside the display region DA simultaneously selects the first memories 51, the second memories 52, or the third memories 53 in the respective sub-pixels SPix. Consequently, the display device 1 can display one image (one frame), among three images (three frames) stored in the display device 1, by switching selection of a memory from one to another among the first memory 51 to the third memory 53 in each of the sub-pixels SPix. Thus, the display device 1 can change the entire image simultaneously and quickly. The display device 1 enables animation display (moving image display) by sequentially switching selection of a memory from one to another among the first memory 51 to the third memory 53 in each of the sub-pixels SPix.

In the display device disclosed in JP-A-09-212140, each of the pixels includes not only a plurality of memories but also a memory selection control circuit for switching memories and an overwrite instruction circuit. The display device disclosed in JP-A-09-212140 therefore cannot meet the demand for making image display panels further reduced in size and higher in definition.

In contrast, the display device 1 in this embodiment is configured such that the gate line selection circuit 10 disposed in the frame region GD selects the first memories 51, the second memories 52, or the third memories 53 when sub-pixel data is written. The display device 1 is also configured such that the memory selection circuit 8 disposed in the frame region GD selects the first memories 51, the second memories 52, or the third memories 53 when sub-pixel data are read out. This configuration makes it unnecessary for the respective pixels Pix to include individual circuits for switching memories. Thus, the display device 1 can meet the demand for making image display panels further reduced in size and higher in definition.

Furthermore, the display device 1 in the embodiment is also capable of, during a period for which an image is displayed based on sub-pixel data stored in memories that are the first memories 51, the second memories 52, or the third memories 53, writing sub-pixel data into other memories that are the first memories 51, the second memories 52, or the third memories 53. Thus, the display device 1 can also write sub-pixel data for an image while displaying another image.

5. Application Example

Figure 10:
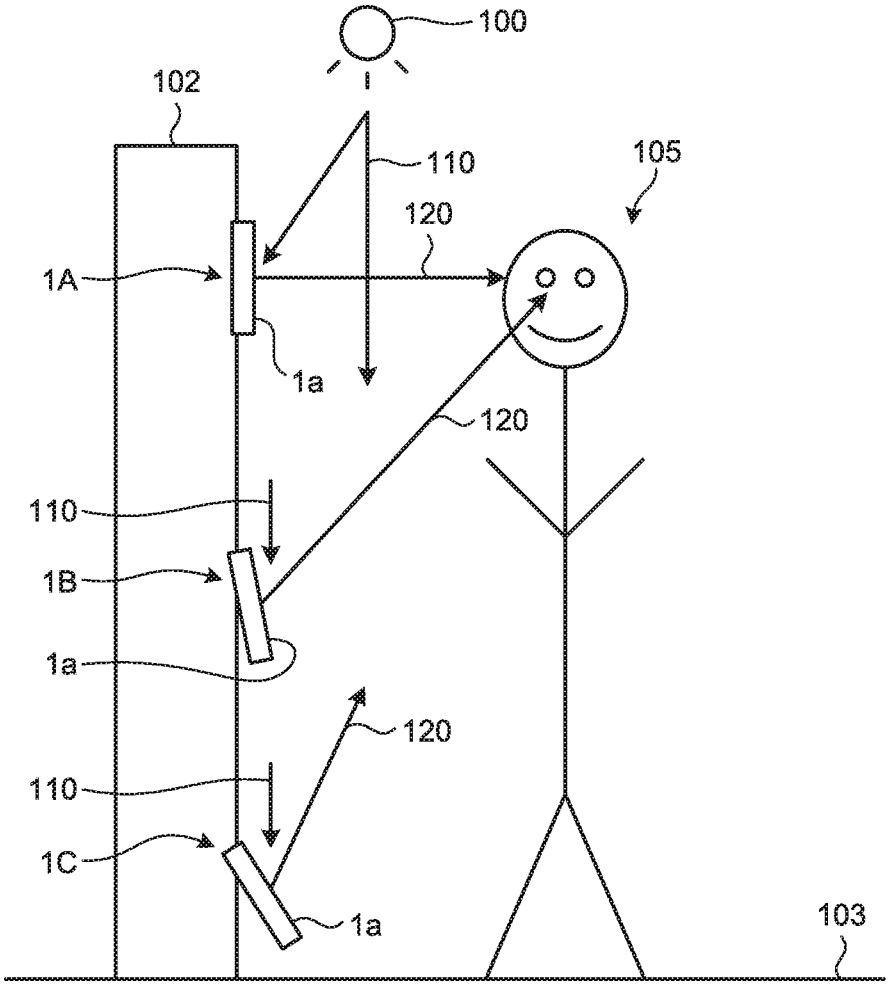
FIG. 10 illustrates an application example of the display device in the embodiment.

FIG. 10 illustrates an application example of the display device 1 in the embodiment. FIG. 10 illustrates an example in which the display device 1 is applied to an electronic shelf label.

As illustrated in FIG. 10, display devices 1A, 1B, and 1C are individually attached to a shelf 102. Each of the display devices 1A, 1B, and 1C has the same configuration as the above described display device 1. The display devices 1A, 1B, and 1C are installed at different heights from a floor surface 103 and with different panel tilt angles. The panel tilt angles are angles formed by the normal lines of display surfaces 1*a* of the respective display devices and the horizontal direction. The display devices 1A, 1B, and 1C reflects light 110 incident thereon from lighting equipment 100 as a light source, thereby causing images 120 to emit toward an observer 105.

While preferred embodiments of the present invention have been described heretofore, these embodiments are not intended to limit the present invention. Descriptions disclosed in these embodiments are merely illustrative, and can be modified variously without departing from the spirit of the present invention. Modifications made without departing from the spirit of the present invention naturally fall within the technical scope of the present invention. At least any of omission, replacement, and modification can be made in various manners to any constituent element in the above described embodiment and each of the modifications without departing from the spirit of the present invention.

What is claimed is:

1. A display device comprising:

a plurality of sub-pixels, each of the sub-pixels including
a sub-pixel electrode,
a first memory and a second memory each of which is configured to store therein sub-pixel data provided by a source line,
a switch circuit configured to output a signal for display of the sub-pixel to the sub-pixel electrode based on the sub-pixel data output from the first memory or the second memory,
a first memory switch provided between the first memory and the switch circuit,
a second memory switch provided between the second memory and the switch circuit,
first gate switch provided between the source line and the first memory, and
a second gate switch provided between the source line and the second memory, a first memory selection line electrically coupled to the respective first memory switches in corresponding sub-pixels;

a second memory selection line electrically coupled to the respective second memory switches in the corresponding sub-pixels; and a memory selection circuit configured to output a memory selection signal to either
the first memory selection line or
the second memory selection line, a first gate selection line electrically coupled to the respective first gate switches in the corresponding sub-pixels;

a second gate selection line electrically coupled to the respective second gate switches in the corresponding sub-pixels; and a gate selection circuit configured to output a gate selection signal to either the first gate selection line or
the second gate selection line,
wherein
the memory selection circuit causes the display area to change an entire image in the sub-pixels simultaneously by, in a first period, selecting either:
the first memories in all of the sub-pixels and none of the memories other than the first memories in all of the sub-pixels, while none of the first gate switches and none of the second gate switches being selected by the gate selection circuit; or
the second memories in all of the sub-pixels and none of the memories other than the second memories in all of the sub-pixels, while none of the first gate switches and none of the second gate switches being selected by the gate selection circuit.

2. The display device according to claim 1,
wherein the gate selection circuit causes the memories in the subpixels to change the sub-pixel data of the sub-pixels simultaneously by, in a second period different from the first period, selecting either:
the first gate switches in all of the sub-pixels and none of the gate switches other than the first gate switches in all of the sub-pixels, while none of the first memory switches and none of the second memory switches being selected by the memory selection circuit; or
the second gate switches in all of the sub-pixels and none of the gate switches other than the second switches in all of the sub-pixels, while none of the first memory switches and none of the second memory switches being selected by the memory selection circuit.

3. The display device according to claim 2, wherein, in a third period different from the first period and the second period:
in accordance with the first memory selection line that has the memory selection signal supplied thereto, each of the sub-pixels displays an image based on the sub-pixel data stored in the first memory in the sub-pixel; and
at the same time, in accordance with the second gate selection line that has the gate signal supplied thereto, each of the sub-pixels stores the sub-pixel data that has been supplied to the corresponding source line in the second memory in the sub-pixel.

4. The display device according to claim 2, wherein
the sub-pixel further comprises:
a third memory configured to store therein sub-pixel data provided by the source line;
a third memory switch provided between the third memory and the switch circuit; and
a third gate switch provided between the source line and the third memory,
the switch circuit is configured to output the signal for display of the sub-pixel to the sub-pixel electrode based on the sub-pixel data output from the first memory, the second memory, or the third memory, the switch circuit being coupled to the third memory through the third memory switch,
the display device further comprises:
a third memory selection line electrically coupled to the third memory switch of each sub-pixel; and
a third gate selection line electrically coupled to the respective third gate switches in the corresponding sub-pixels,
wherein the memory selection circuit configured to output the memory selection signal to either
the first memory selection line, or
the second memory selection line, or
the third memory selection line,
the gate selection circuit configured to output the gate selection signal to either
the first gate selection line, or
the second gate selection line, or
the third selection line,
wherein,
the gate selection circuit causes the memories to change the sub-pixel data of the sub-pixel simultaneously by, in the second period, selecting either:
the first gate switches in all of the sub-pixels and none of the gate switches other than the first gate switches in all of the sub-pixels, while none of the first memory switches, none of the second memory switches, and none of the third memory switches being selected by the memory selection circuit; or
the second gate switches in all of the sub-pixels and none of the gate switches other than the second switches in all of the sub-pixels, while none of the first memory switches, none of the second memory switches, and none of the third memory switches being selected by the memory selection circuit; or
the third gate switches in all of the sub-pixels and none of the gate switches other than the third switches in all of the sub-pixel, while none of the first memory switches, none of the second memory switches, and none of the third memory switches being selected by the memory selection circuit.

5. The display device according to claim 1, further comprising:
a common electrode configured to be supplied with a common potential that is common to the sub-pixels;
a common-electrode driving circuit configured to invert the common potential in synchronization with a reference signal and output the inverted or non-inverted common potential to the common electrode;
a pair of display signal lines including a first display signal line and a second display signal line, each of the display signal lines being electrically coupled to the respective switch circuits in the corresponding sub-pixels,
the first display signal line provides the inverted common potential,
the second display signal line provides the non-inverted common potential; and
the first display signal line or the second display signal line is connected to corresponding pixel electrodes based on the output from the first or second memories.

6. The display device according to claim 1,
wherein the memory selection circuit sequentially switches a destination to which the memory selection signal is to be output, from one to another among the first memory selection line and the second memory selection line, and
wherein, in accordance with the sequential switching of the destination to which the memory selection signal is to be output, each of the sub-pixels changes the image based on the sub-pixel data stored in the memories.

7. The display device according to claim 1,
wherein each of the sub-pixels further comprising:
a third memory configured to store therein the sub-pixel data provided by the source line;
a third memory switch, the switch circuit being coupled to the third memory through the third memory switch; and a third gate switch provided between the source line and the third memory, wherein the switch circuit is configured to output the signal for display of the sub-pixel to the sub-pixel electrode based on the sub-pixel data output from the first memory, or the second memory, or the third memory, wherein the display device further comprises a third memory selection line electrically coupled to the respective third memory switches in the corresponding sub-pixels, and a third gate selection line electrically coupled to the respective third gate switches in the corresponding sub-pixels;

wherein the memory selection circuit configured to output the memory selection signal to either the first memory selection line, or the second memory selection line, or the third memory selection line, wherein the gate selection circuit configured to output the gate selection signal to either the first gate selection line or the second gate selection line, or the third gate selection line, wherein the memory selection circuit causes the display area to change the entire image simultaneously by, in the first period, selecting either:

the first memories in all of the sub-pixels and none of the memories other than the first memories in all of the sub-pixels, while none of the first gate switches, none of the second gate switches, and none of the third gate switches being selected by the gate selection circuit; or the second memories in all of the sub-pixels and none of the memories other than the second memories in all of the sub-pixels, while none of the first gate switches, none of the second gate switches, and none of the third gate switches being selected by the gate selection circuit; or the third memories in all of the sub-pixels and none of the memories other than the third memories in all of the sub-pixels, while none of the first gate switches, none of the second gate switches, and none of the third gate switches being selected by the gate selection circuit.

* * * * *